United States Patent [19]

Seo et al.

[11] Patent Number: 5,066,779

[45] Date of Patent: Nov. 19, 1991

[54] CATALYTIC PROCESS FOR PRODUCING RAW MATERIAL PITCH FOR CARBON MATERIALS FROM NAPHTHALENE

[75] Inventors: Ikuo Seo, Iwaki; Tooru Oono, Fujushima; Yosinobu Murakami, Iwaki, all of Japan

[73] Assignee: Kureha Kagaku Kogyo Kabushiki Kaisha, Tokyo, Japan

[21] Appl. No.: 472,260

[22] Filed: Jan. 30, 1990

[30] Foreign Application Priority Data

Feb. 2, 1989 [JP] Japan ..... 1-24592

[51] Int. Cl.[5] ..... C08G 61/10; C08G 83/00

[52] U.S. Cl. ..... 528/396; 423/449; 585/11; 585/422

[58] Field of Search ..... 528/396; 423/449; 585/11, 422

[56] References Cited

U.S. PATENT DOCUMENTS 3,565,832 2/1971 Bilow et al. ..... 528/396

4,457,828 7/1984 Lewis ..... 528/396

*Primary Examiner*—Harold D. Anderson

*Attorney, Agent, or Firm*—Oblon, Spivak, McClelland, Maier & Neustadt

[57] ABSTRACT

The present invention discloses a process for producing a raw material pitch for carbon materials containing a slight amount of ash, the comprising steps of adding aluminum chloride to naphthalene or its derivative as a catalyst; polymerizing said naphthalene or its derivative at a temperature of 100° to 330° C., adding water to the polymer, under stirring if necessary; maintaining the mixture in an emulsified state for a predetermined time under stirring, breaking an emulsion, removing a water layer from the polymer.

11 Claims, No Drawings

CATALYTIC PROCESS FOR PRODUCING RAW MATERIAL PITCH FOR CARBON MATERIALS FROM NAPHTHALENE

BACKGROUND OF THE INVENTION

The present invention relates to a process for producing a raw material pitch for carbon materials by polymerizing naphthalene or its derivative in the presence of aluminum chloride as a catalyst, obtaining a water in oil emulsion by adding a predetermined amount of water to the polymer and efficiently removing residual catalysts thereby from the polymer.

A conventional method of producing a pitch by polymerizing naphthalene or its derivative in the presence of a Lewis acid as a catalyst is disclosed in U.S. Pat. No. 4,863,708.

When naphthalene or its derivative (hereinafter referred to as "naphthalene et al.") is polymerized in the presence of a Lewis acid, especially, aluminum chloride, a raw material pitch, having a high softening point and excellent physical properties, for carbon materials is obtained. However, physical properties such as strength, of the obtained carbon materials, for example, carbon fibers, are not necessarily in a satisfactory level.

It has been considered that the above problem can be solved if the residual catalysts in the polymer can be removed efficiently. For instance, an attempt was made to remove residual aluminum chloride by heating the polymer to the temperature higher than a subliming point of the chloride, 183° C. However, when naphthalene et al. is polymerized in the presence of aluminum chloride as a catalyst, a considerable amount of the chloride is denaturalized after it has functioned as the catalyst. As a result, a relatively high amount of residual catalyst was remained in the polymer even after the polymer was heated to 300° C. Accordingly, the method did not work.

In addition, since the chemical structure of denaturalized aluminum chloride is unknown, it is difficult to predict an effective method to remove it from the polymer. So far, generally known methods of removing a residual catalyst such as a method of extracting with a solvent, a method of depositing, a method of filtering or a method of washing with water are adopted at random. However, each method has the following problem and any one of the method can not be satisfactory. Accordingly, more efficient and exact method of removing residual catalyst has been wanted seriously.

For example, in a water washing, as a difference in specific gravity between water and the polymer is too large, although it is very easy to separate the polymer and water after washing, it is difficult to maintain a stable emulsion and even when the polymer is thrown into a large amount of water it is not possible to remove the residue effectively. In a solvent extraction or a depositing method, when a conventional solvent is used, separation of residual catalyst from polymer is very difficult and a use of a special and expensive solvent turns out to be essential, therefore high expense for the separation can not be avoided. Further, in a depositing or a filtering method, since a residual catalyst contains a considerable amount of very fine particles, long filtering time for separating residual catalyst from a liquid is required and makes the methods inefficient.

As a result of an extensive study to solve the above problems and establish a method to remove the residual catalyst economically and efficiently, the present inventors have found that not only aluminum chloride but also denaturalized residual catalyst are dissolved well in water and further studied to make a contact between water and the residual catalyst very good with an expectation that in that case water, which is inexpensive and quite easy to handle, can be used as a washing liquid. Finally, the inventors have found that a very stable emulsion can be maintained if water is added into the polymer, quite contrary to the conventional concept of adding the polymer into a large amount of water. Based on the finding, the inventors attained the present invention.

SUMMARY OF THE INVENTION

An object of the present invention is to provide a process for producing a raw material pitch which is capable of efficiently producing carbon materials having high strength.

An another object of the present invention is to provide a process for producing a raw material pitch, for carbon materials, having a very slight amount of residual polymerization catalyst.

A still another object of the present invention is to provide a process for producing a raw material pitch, for carbon materials, having a high purity by polymerizing naphthalene et al. at a temperature of 100° to 330° C. in the presence of aluminum chloride, adding water to the polymer so as to obtain quite stable water in oil type emulsion and removing the residual catalyst efficiently.

DETAILED EXPLANATION OF THE INVENTION

The present invention relates to a process to produce a raw material pitch, for carbon materials, containing a small amount of ash, preferably not more than 0.01% by polymerizing naphthalene et al. at a temperature of 10° to 330° C. in the presence of aluminum chloride and removing a residual catalyst, which includes aluminum chloride and denaturalized aluminum chlorides, which comprises:

adjusting a viscosity of the polymer according to the necessity, adding water to the polymer, under stirring if necessary, maintaining a stable water in oil type emulsion for a predetermined time under stirring, transferring the residual catalysts to the water and separating the polymer from the water and preferably treating the polymer by electrostatic oil purification method and/or after-treatment.

The process according to the present invention will be explained in detail in the following order of steps, (1) polymerization, (2) adjustment of viscosity, (3) removal of residual catalyst, (4) electrostatic oil purification and (5) after-treatment.

(1) Polymerization

When naphthalene et al. is polymerized in the presence of aluminum chloride catalyst, preferably 5 to 50 parts by weight, more preferably 8 to 20 parts by weight of aluminum chloride is added on the basis of 100 parts by weight of naphthalene et al. If aluminum chloride is used less than 5 parts by weight, the molecular weight distribution of a pitch obtained is prone to be broad and a molded carbon product having a high strength is difficult to obtain and, in an extreme case which requires severe conditions, for instance fiber spinning, it is sometimes impossible to obtain a molded product. On the other hand, if aluminum chloride is used more than 50 parts by weight, it becomes more and more difficult to remove a residual catalyst with an inevitable increase of a polymerization degree of the polymer.

A polymerization temperature is in the range of 100° to 330° C., preferably 150° to 300° C. If the temperature is higher than 330° C., spherical crystals are developed in the polymer during polymerization, thereby making the removal of the catalyst difficult, and if the temperature is lower than 100° C., the polymerization takes too long time and makes the process commercially disadvantageous. The preferable polymerization time is between 0.5 and 100 hours.

(2) Adjustment of viscosity

A viscosity of the polymer measured at the temperature, when water is added, with a B-type viscometer (hereinafter the viscosity of a polymer is measured with a B-type viscometer unless otherwise specified) is preferably not more than 300 centipoise, more preferably 10 to 150 centipoise. The temperature of the polymer when water is added can be optionally determined as far as the viscosity of the polymer measured at the temperature is within a predetermined range. However, if the temperature is too high, several troubles are prone to be occurred, such as the polymerization might further proceed too much, volatile components might be emitted or the water added might evaporate and on the other hand, if the temperature is too low, handling of the polymer is prone to be difficult. Usually, the temperature is preferably in the range of 70° to 90° C. and a viscosity of the polymer is preferably not more than 300 centipoise measured at the temperature optionally determined within the range for the addition of water. It is because if the viscosity is higher than 300 centipoise, a dispersion of water in the polymer is tend to be difficult, accordingly, a stable water-in-oil type emulsion may become difficult to maintain.

If a temperature of the polymer at the time of adding water varies during the step, it is preferable to make the viscosity of the polymer measured at the lowest temperature not more than 300 centipoise.

When the polymer has a too high viscosity which is to be lowered to not more than 300 centipoise, a viscosity modifier is to be added to the polymer. The viscosity modifier is not have to be specified and any liquid or solid type can be used so long as it can lower a viscosity of the polymer, but use of naphthalene et al., a starting material, is advantageous because it can be recovered and reused after the removal of the residual catalyst.

(3) Removal of residual catalyst

Water is added, under stirring if necessary, to the polymer obtained at the step (1) or the polymer viscosity-adjusted at the step (2) and the mixture is emulsified under stirring. Adding the polymer into water as in a conventional method is inappropriate because the mixture is separated into layers The amount of water to be added is preferably 20 to 400 parts by weight, more preferably 30 to 300 parts by weight based on 100 parts by weight of the polymer. Generally speaking, when water is added to a polymerization system of naphthalene et al. under stirring, until the amount of water reaches four times of the amount of the polymer in weight, water is in a disperse phase and the polymer is in a continuous phase and it is easy to maintain a stable emulsion of the mixture and therefore it also is easy to transfer the residual catalyst from the continuous phase to the dispersed phase, namely, from the polymer to water. That is, the emulsification accelerates the transfer of the residual catalyst to water and increases its diffusion rate, thereby shortening the washing time. Since, when the amount of water exceeds four times of the amount of polymer in weight, the emulsion is tend to be broken in accordance with the increase of water, it is recommendable that until the transfer of the residual catalyst to the water is completed, water should be added slowly under stirring (when the amount of water reaches near to 400 parts by weight to 100 parts by weight of the polymer, one must be careful not to break the emulsion until the transfer reaches to a satisfactory level) and after that further water is added to break the emulsion into two layers. This makes a separation of the polymer and water quite easy and efficient. A lower limit of amount of water to be added should be determined according to the amount of catalyst used. Too small amount of water, for instance not more than 20 parts by weight, is unfavorable because transfer of the residual catalyst is insufficient. The temperature of emulsion, namely, the temperature of transfer of the residual catalyst to water is preferably 70° to 90° C.

The residual catalyst in the present invention involves unchanged aluminum chloride and aluminum chloride denaturalized at the polymerization temperature after it has functioned as the catalyst.

The time for maintaining the emulsion is to be determined by the amount of catalyst used and the amount of water added, but usually it is preferable not less than 10 minutes.

After the residual catalyst has been transferred to the water, the emulsion is broken into layers of the polymer and the water, and the water layer containing the residual catalyst is removed. The emulsion can be broken by adding excess water, as described above, or can be mechanically broken with an equipment such as a coalescer. The two layers are separated by decantation, gravity separation or other method and if necessary, separated polymer layer is dried.

(4) Electrostatic oil purification

A slight amount of catalyst remaining in the polymer is preferably removed by electrostatic oil purification so as to further reduce the residual catalyst in the polymer. Electrostatic oil purification is a method of removing the residual catalyst by creating an electric field between a cathod and an anode by applying a high-voltage direct current source to give fine foreign particles an electric charge and attracting the fine particles to a pole having the opposite polarity. In the case of the present polymerization system, fine metal particles are positively charged and attracted to a cathode.

An equipment for electrostatic oil purification is exemplified by an electrostatic oil purifier manufactured by KLEENTEK KOGYO Ltd.

(5) After-treatment

The polymer of naphthalene et al. obtained in the step (3) or (4) is heated under normal pressure or a reduced pressure, with or without a flow of an inert gas, in an atmosphere of an inert gas to remove volatile components according to the necessity, and to obtain a raw material pitch. The heat treatment means the process of heating the pitch to such a degree as to cause a dehydrogenation reaction. Usually, the heating temperature is not lower than 380° C. However, except in a particular case when a low temperature heating is essential, a heating temperature slightly higher than 380° C. is unfavorable because the dehydrogenation reaction takes a long time. The pitch may be converted into meso-phase pitch by further heat treatment if necessary, or an isotropic pitch without further heat treatment can also be used. Examples of heat treatment before molding are described in Japanese Patent Publication No. 53-7,533(1978) and U.S. Pat. No. 4,645,826.

The raw material pitch obtained in the present invention is thereafter formed in an optional form, infusibilized and carbonized, and further graphitized if necessary, to obtain carbon materials. Forming is not necessarily restricted to spinning described in the following Examples but involves any forming such as film forming, sheet forming or sphere forming. A conventional method can be applied for infusibilizing, carbonizing or graphitizing the formed pitch.

According to the present invention, since water is added to the polymer obtained by the polymerization of naphthalene et al., a stable water-in-oil emulsion can be maintained and the residual catalyst is efficiently transferred to a water phase, it is possible to reduce an ash content in the raw material pitch to preferably not more than 0.01%, more preferably not more than 0.005%, further preferably not more than 0.002%. The ash content is measured in accordance with JIS K-2425 (1978) except that the amount of sample for measuring is 100 g.

Accordingly, since a raw material pitch of the present invention contains a smaller amount of ash than a pitch having the residual catalyst removed only by washing with water, use of the raw material pitch of the present invention can give carbon materials having an excellent quality.

EXAMPLE

Example 1

1,000 g of naphthalene (first-class reagent, produced by KANTO KAGAKU, Ltd.) and 100 g of aluminum chloride (first-class reagent, produced by KANTO KAGAKU, Ltd.) were charged into a three-necked flask equipped with a stirrer and polymerized at 210° C. for 24 hours. After the polymerization, another 1,000 g of naphthalene was added and the mixture was cooled to 80° C. The viscosity of the polymer diluted with naphthalene was 80 centipoise. 3,500 g of warm water was gradually added to the polymer under stirring and the mixture was emulsified. After the total amount of water was added, the mixture was stirred for half an hour. After almost all water was removed by breaking the emulsion with a coalescer, another 3,500 g of warm water was added and the same procedures as described above were repeated. The ash content in the polymer was 10 ppm (0.001%). The polymer obtained was heated at 400° C. and 15 Torr under a flow of nitrogen for 60 minutes to remove volatile components. The softening point of the pitch obtained was 205° C. The pitch was charged into a cylinder having a nozzle 0.3 mm in diameter and heated to 280° C. and melted. The molten pitch was then extruded for spinning through the nozzle with a nitrogen gas of a pressure of 2.0 kg/cm$^2$G. The take-up rate was about 500 m/minute. The pitch fiber obtained was heated to about 260° C. in an air at a temperature-raising rate of about 1° C./minute and the pitch was held in these conditions for about 30 minutes to be infusiblized. The infusibilized fiber was heated to about 900° C. in an inert atmosphere at a temperature-raising rate of about 5° C./minute to be carbonized and then heated to about 2,000° C. at a temperature-raising rate of about 50° C./minute for graphitization and obtained a graphite fiber having a diameter of 8.0 μm. The tensile strength of the graphite fiber was 425 kg/mm$^2$ and the elasticity modulus was 35 T/mm$^2$.

Example 2

The polymer polymerized in the same manner as in Example 1 was treated by an electrostatic oil purification equipment manufactured by KLEENTEK KOGYO Ltd. The ash content of the polymer thus obtained was 9 ppm (0.0009%). The polymer obtained was heated at 400° C. and 13 Torr under a flow of nitrogen for 60 minutes to remove volatile components. The softening point of the pitch obtained was 204° C. The pitch was spun, infusibilized, carbonized and graphitized in the same way as in Example 1, thereby obtaining a graphite fiber having a diameter of 8.0 μm. The tensile strength of the graphite fiber was 439 kg/mm$^2$ and the elasticity modulus was 36 T/mm$^2$.

Comparative Example 1

The polymer polymerized in the same manner as in Example 1 was charged into 3,500 g of warm water and stirred and washed with water under the same conditions as in Example 1 except the point that the polymer was added to water. In this case, it was impossible to make the mixture emulsified. The mixture was separated into two layers immediately after stirring was stopped and the upper water layer was removed, thereby finishing the step of washing the polymer with water. This washing step was repeated again. An ash content in the polymer after the separation of water layer was 180 ppm (0.018%). The polymer obtained was heated at 400° C. and 13 Torr under a flow of nitrogen for 60 minutes to remove volatile components. The softening point of the pitch obtained was 205° C. The pitch was spun, infusibilized, carbonized and graphitized in the same way as in Example 1, thereby obtaining a graphite fiber having a diameter of 8.0 μm. The tensile strength of the obtained graphite fiber was 280 kg/mm$^2$ and the elasticity modulus was 22 T/mm$^2$.

What is claimed is:

1. A process for producing a raw material pitch for carbon materials comprising the steps of:

adding aluminum chloride to naphthalene or naphthalene derivative as a catalyst; polymerizing said naphthalene or naphthalene derivative at a temperature of 100° to 330° C. to obtain a polymer; adding water to said polymer to obtain a mixture thereof; maintaining said mixture in an emulsified state for a predetermined time under stirring and removing water containing a residual catalyst from said polymer.

2. The process for producing a raw material pitch for carbon materials according to claim 1, wherein said residual catalyst is further removed from said polymer by an electrostatic oil purification method.

3. The process for producing a raw material pitch for carbon materials according to claim 1, wherein a viscosity of said polymer measured at the temperature when a water is added is not more than 300 centipoise when measured with a B-type viscometer.

4. The process for producing a raw material pitch for carbon materials according to claim 3, wherein the viscosity of said polymer is adjusted to not more than 300 centipose, when measured by a B-type viscometer at 90° C., by adding a viscosity modifier.

5. The process for producing a raw material pitch for carbon materials according to claim 1, wherein the amount of water added is 20 to 400 parts by weight based on 100 parts by weight of said polymer.

6. The process for producing a raw material pitch for carbon materials according to claim 1, wherein said predetermined time is at least 10 minutes.

7. The process for producing a raw material pitch for carbon materials according to claim 1, wherein said mixture is maintained at a temperature of 70° to 90° C.

8. The process for producing a raw material pitch according to claim 1, wherein 20 to 400 parts by weight of water is gradually added to 100 parts by weight of said polymer to obtain a mixture thereof, said mixture is maintained in an emulsified state for a predetermined time, and more than 400 parts by weight of water in total, including an amount of the water gradually added to said polymer, is added and a separate water layer is removed from said polymer.

9. The process for producing a raw material pitch for carbon materials according to claim 1, wherein an ash content of said pitch is not more than 0.01%.

10. The process for producing a raw material pitch for carbon materials according to claim 1, wherein an amount of said aluminum chloride is 5 to 50 parts by weight based on 100 parts by weight of naphthalene or naphthalene derivative.

11. The process for producing a raw material pitch for carbon materials according to claim 4, wherein said viscosity modifier is naphthalene or naphthalene derivative, which is a starting material for the polymerization step.

* * * * *